US005588628A

United States Patent [19]

Sachleben

[11] Patent Number: 5,588,628

[45] Date of Patent: Dec. 31, 1996

[54] COLLAPSIBLE REEL

[76] Inventor: Harold G. Sachleben, 19 Adams Ave., Bellmawr, N.J. 08031

[21] Appl. No.: 348,985

[22] Filed: Nov. 28, 1994

[51] Int. Cl.[6] ..... B65H 75/24; B65H 75/22

[52] U.S. Cl. ..... 242/607.1; 242/407.1

[58] Field of Search ..... 242/607.1, 407.1

[56] References Cited

U.S. PATENT DOCUMENTS

| | | | |
|---|---|---|---|
| 1,559,133 | 10/1925 | Tunis et al. | 242/607.1 |
| 2,909,340 | 10/1959 | Whitaker | 242/607.1 |
| 3,301,500 | 1/1967 | Shackson | 242/607.1 |
| 3,791,606 | 2/1974 | Brown | 242/607.1 |
| 4,198,012 | 4/1980 | Esmonde et al. | 242/607.1 |
| 4,561,607 | 12/1985 | Vagan | 242/118.4 |
| 5,169,086 | 12/1992 | Vesely | 242/607.1 |

FOREIGN PATENT DOCUMENTS

| | | |
|---|---|---|
| 559625 | 9/1932 | Germany . |
| 277830 | 8/1927 | United Kingdom . |
| 467787 | 7/1937 | United Kingdom . |
| 589990 | 7/1947 | United Kingdom . |

*Primary Examiner*—John Q. Nguyen
*Attorney, Agent, or Firm*—Cushman Darby & Cushman IP Group of Pillsbury Madison & Sutro, LLP

[57] ABSTRACT

A barrel folding reel including a first flange and a second flange spaced apart from and opposing one another is disclosed. A plurality of cooperating barrel members, each having a first end portion and a second end portion that are pivotally mounted to the first flange and the second flange, respectively, longitudinally extend between the flanges so as to define an operative position of barrel folding reel. An actuator member positioned adjacent to the first flange engages the first end portion of at least one, but not all, of the barrel members. The actuator is constructed and dimensioned so that it may be rotationally displaced to collectively rotate the barrel members engaged thereto ninety degrees about their longitudinal axes. The rotated barrel members are thereby aligned with the barrel members not attached to the actuator member. After aligning the barrel members, the barrel folding reel can be moved from its operative position to a collapsed position.

24 Claims, 12 Drawing Sheets

COLLAPSIBLE REEL

BACKGROUND OF THE INVENTION

1. Field of Invention

The present invention relates generally to a collapsible cable reel for use in storing, shipping, inventorying, and dispensing insulated electrical wire, cable, and the like.

2. Description of Related Art

Barrel reels are extensively used for storing and transporting electrical and steel cables and wires and the like. Barrel reels typically consist of a cylindrical drum portion upon which the cable or wire is wound and spaced-apart flanges extending in a perpendicular, radial direction from the respective ends of the drum portion. Barrel reels have been formed from a wide variety of materials, including metal, wood, and cardboard.

Unfortunately, because of the excessive size and bulk of conventional barrel reels, it is often economically infeasible to store and transport conventional reels to wire manufacturers or suppliers for re-use after the cable or wire has been removed therefrom. Consequently, the disposal of conventional reels after only a single use results in a wasteful accumulation of reels. Moreover, the need to manufacture new reels is economically inefficient and inflicts harmful effects on the environment.

In order to overcome these problems, several efforts have been made to design a collapsible, recyclable barrel reel. For example, U.S. Pat. No. 5,169,086 issued to Vesely discloses a collapsible reel that includes opposing flanges connected by strut assemblies that are pivotally connected at a split along their mid-portions. A bolt/spring arrangement maintains the connection of the barrel members to their flanges. The pivotal connections allow the reel to pivot between a closed position and an open, extended position. U.S. Pat. No. 2,909,340 issued to Whitaker illustrates a collapsible wire reel having a collapsible metallic reel element composed of a plurality of wedge-shaped sector pairs. For each sector pair, the outer ends of the sectors are secured in slots of the flanges, while the inner ends of the sectors are connected by hinges to one another.

However, the above-mentioned barrel folding reels, as well as other conventional barrel folding reels, require a large number of parts in order to effectuate the collapsing movement. In addition, these barrel folding reels typically cannot be moved into a collapsible position absent the use of expensive tools and the assistance of several persons.

SUMMARY OF THE INVENTION

It is therefore an object of the present invention to overcome the above-described problems by providing a collapsible reel (also referred to herein as a barrel barrel folding reel) with a reduced number of moving parts, thereby allowing one person alone to move the barrel folding reel between an operative position and a collapsed position.

It is another object of the present invention to provide a barrel folding reel that does not require any tools for moving the reel between its operative and collapsible positions.

It is still another object of the present invention to provide a barrel folding reel that can be moved from an operative position to a collapsed position in a short period of time.

It is a further object of the present invention to provide a barrel folding reel that occupies approximately 70% less space when in its collapsed position; possesses the strength and durability to withstand the physical stress and demands of repeated use; and satisfies the economical shipping conditions for returning the reels to the manufacturers and/or suppliers.

It is still a further object of the present invention to provide a barrel folding reel that is capable of being fabricated from a wide variety of materials, including steel, aluminum, molded plastic, reinforced molded plastic compounds, and wood.

Accordingly, the present invention discloses a barrel folding reel that includes a first flange and a second flange axially spaced with respect to each other by a plurality of cooperating barrel members or tubes extending longitudinally therebetween. Each barrel member has a first end portion and a second end portion that are pivotally mounted to the first flange and the second flange, respectively. The barrel folding reel further includes an actuator plate positioned adjacent to the first flange. The actuator plate engages some, but not all, of the barrel members. The actuator plate is further constructed and dimensioned so that it may be rotationally displaced to collectively rotate only the barrel members engaged thereto, thereby aligning all of the barrel members and allowing the barrel folding reel to be moved from an operative position to a collapsed position. The barrel folding reel further includes a locking mechanism for securing the barrel folding reel in its operative position.

These and other objects, features, and advantages of the present invention will become apparent from the following detailed description when taken in conjunction with the accompanying drawings which illustrate, by way of example, the principles of the invention.

BRIEF DESCRIPTION OF THE DRAWING

The accompanying drawings illustrate the invention. In such drawings.

DESCRIPTION OF THE PREFERRED EMBODIMENTS

Figure 1:
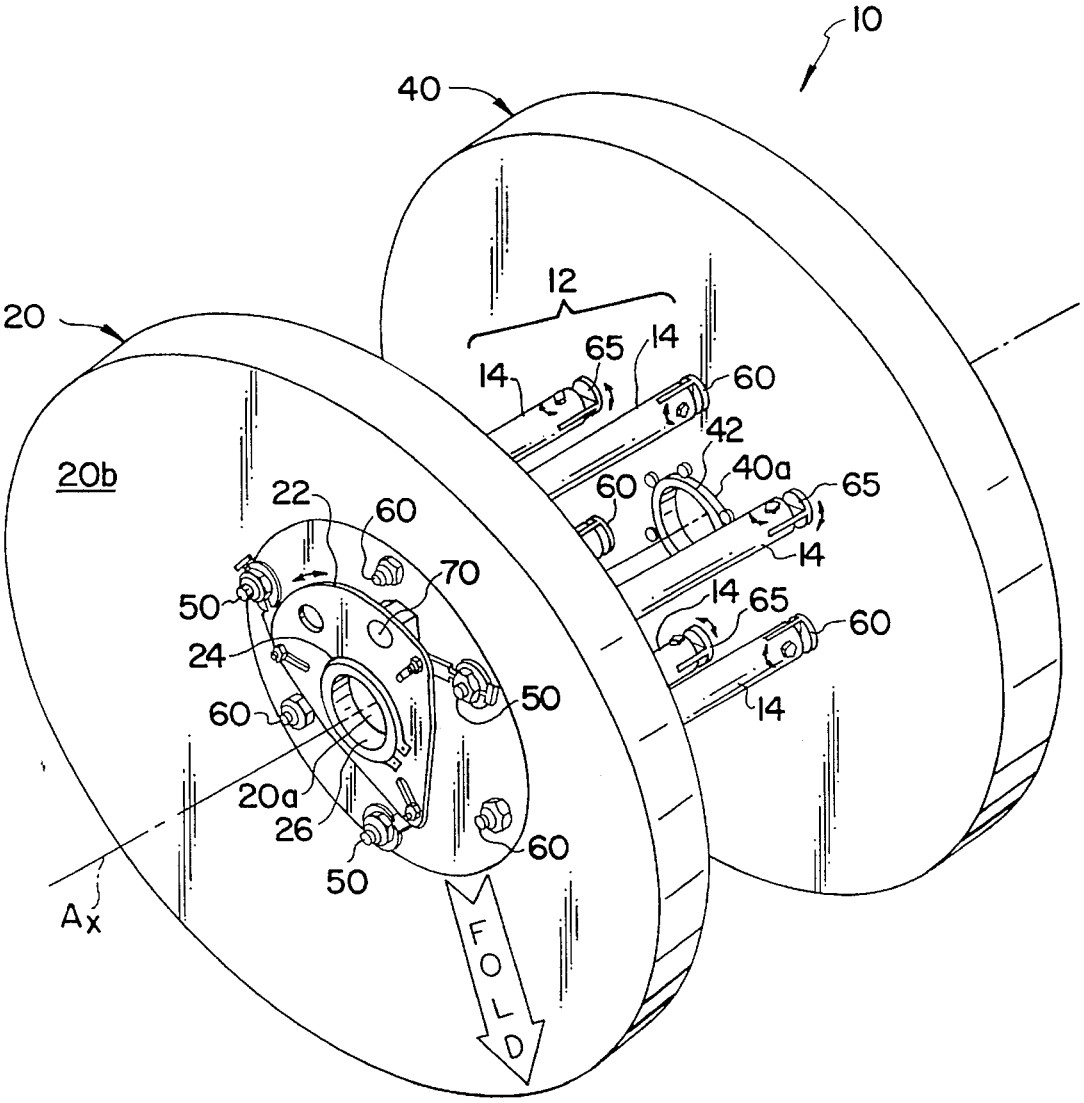
FIG. 1 is a perspective view of the barrel folding reel in its operative position as encompassed by a first embodiment of the present invention.

A detailed description of the present invention is provided below.

As shown in the accompanying drawings, preferred embodiments of a barrel folding reel in accordance with the present invention are designated generally by the reference numeral 10.

Figure 2A:
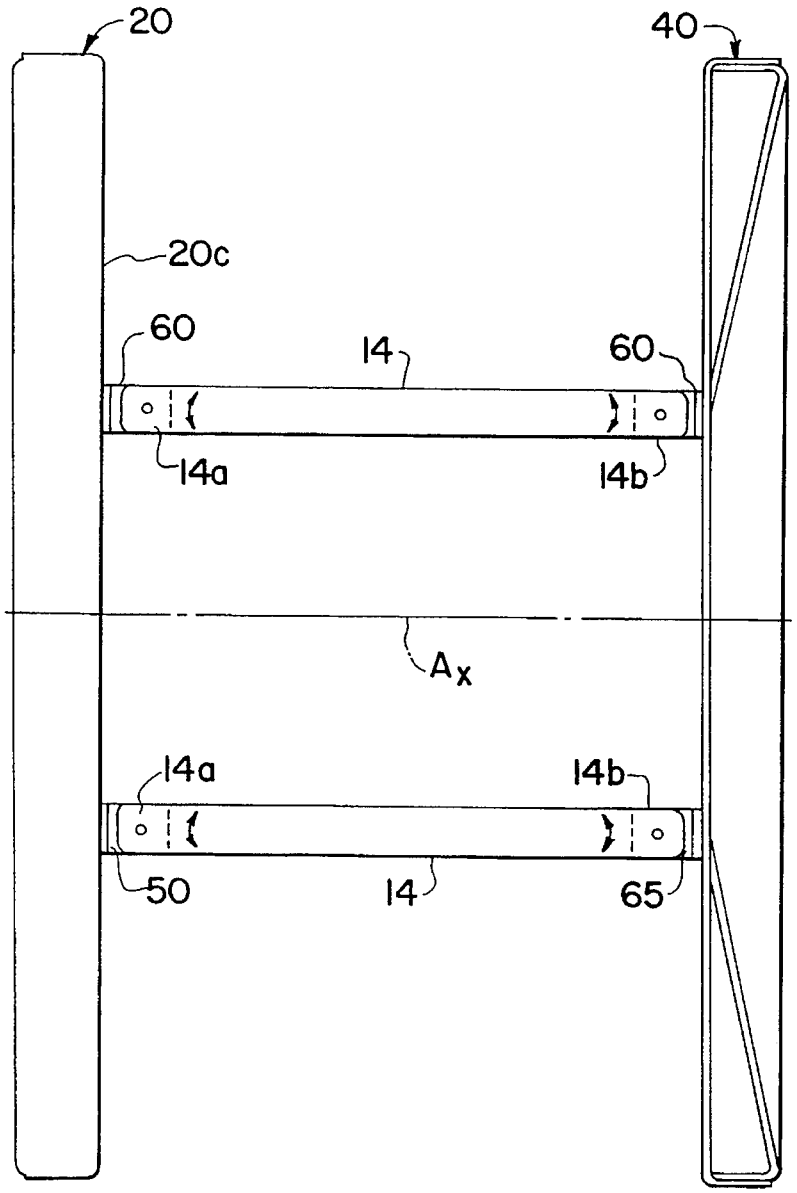
FIG. 2A is a side view of the barrel folding reel in its collapsible position as encompassed by the first embodiment of the present invention.
Figure 2B:
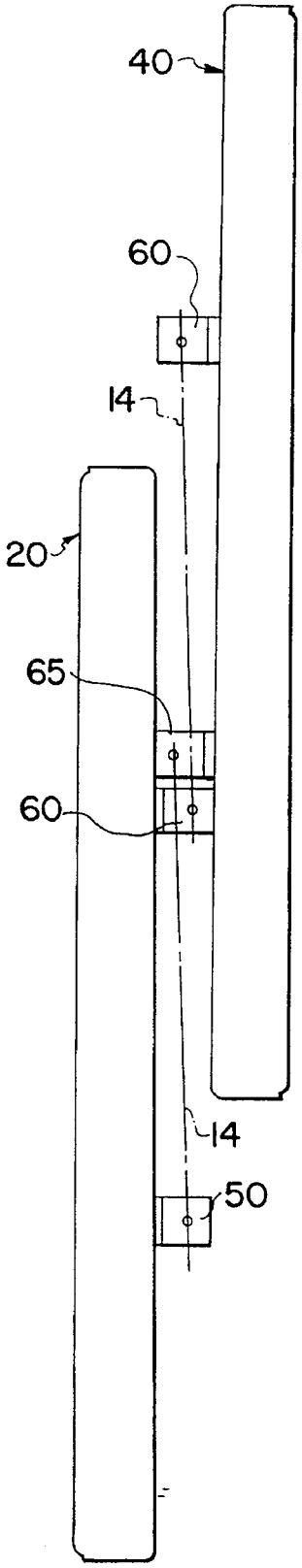
FIG. 2B is a side view of the barrel folding reel in its collapsed position as encompassed by the first embodiment of the present invention.

As shown in FIGS. 1 and 2, the barrel folding reel 10 as encompassed by a first embodiment of the present invention includes an actuator flange 20 and a plain flange 40. The flanges 20 and 40 are preferably of an annular-shape, respectively possessing a central aperture 20*a* and 40*a* (not shown in FIGS. 2A and 2B) positioned concentrically therein. The flanges 20 and 40 preferably have variable thicknesses. More specifically, there is preferably an outer first annular area of constant thickness along the outer radial portion of the flanges 20 and 40. As shown in FIG. 2A, the thickness of the flanges 20 and 40 tapers to an inner annular area of a smaller constant thickness positioned radially inward with respect to said first area.

It is understood that the present invention encompasses flanges having alternative shapes and dimensions, since such minor variations would be readily recognized by a skilled artisan.

A wire starting hole 80 (shown in FIG. 9) may be provided in one or both of the flanges 20 and 40 for securing the cable or wire in place during the winding thereof.

In its operative position (FIG. 2A), the flanges 20 and 40 of the barrel folding reel 10 are coaxially spaced apart from each other and are aligned along central axis $A_x$.

Figure 3:
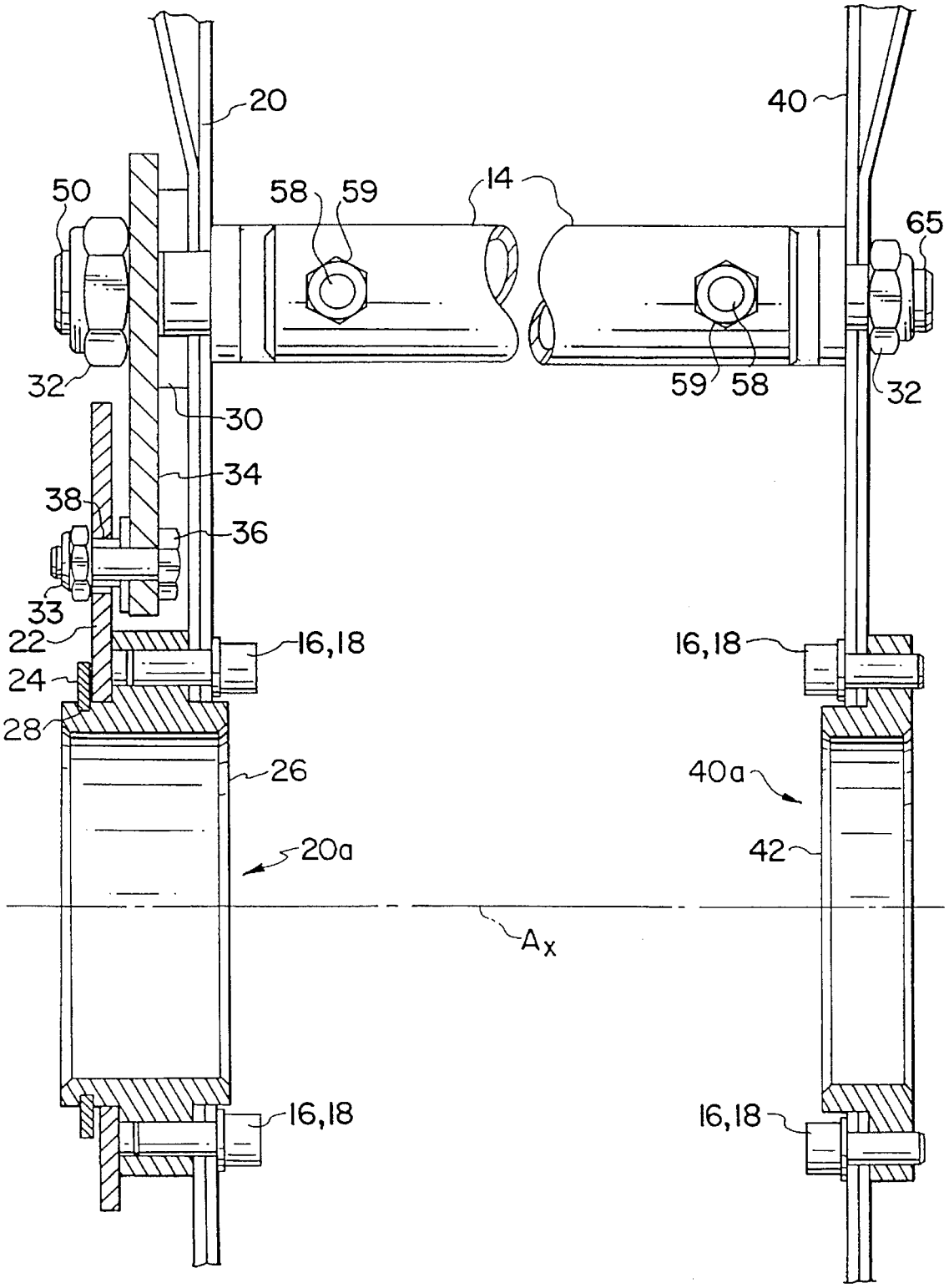
FIG. 3 is a partial cross-sectional side view of the barrel folding reel in its operative position as encompassed by the first embodiment of the present invention.
Figure 4:
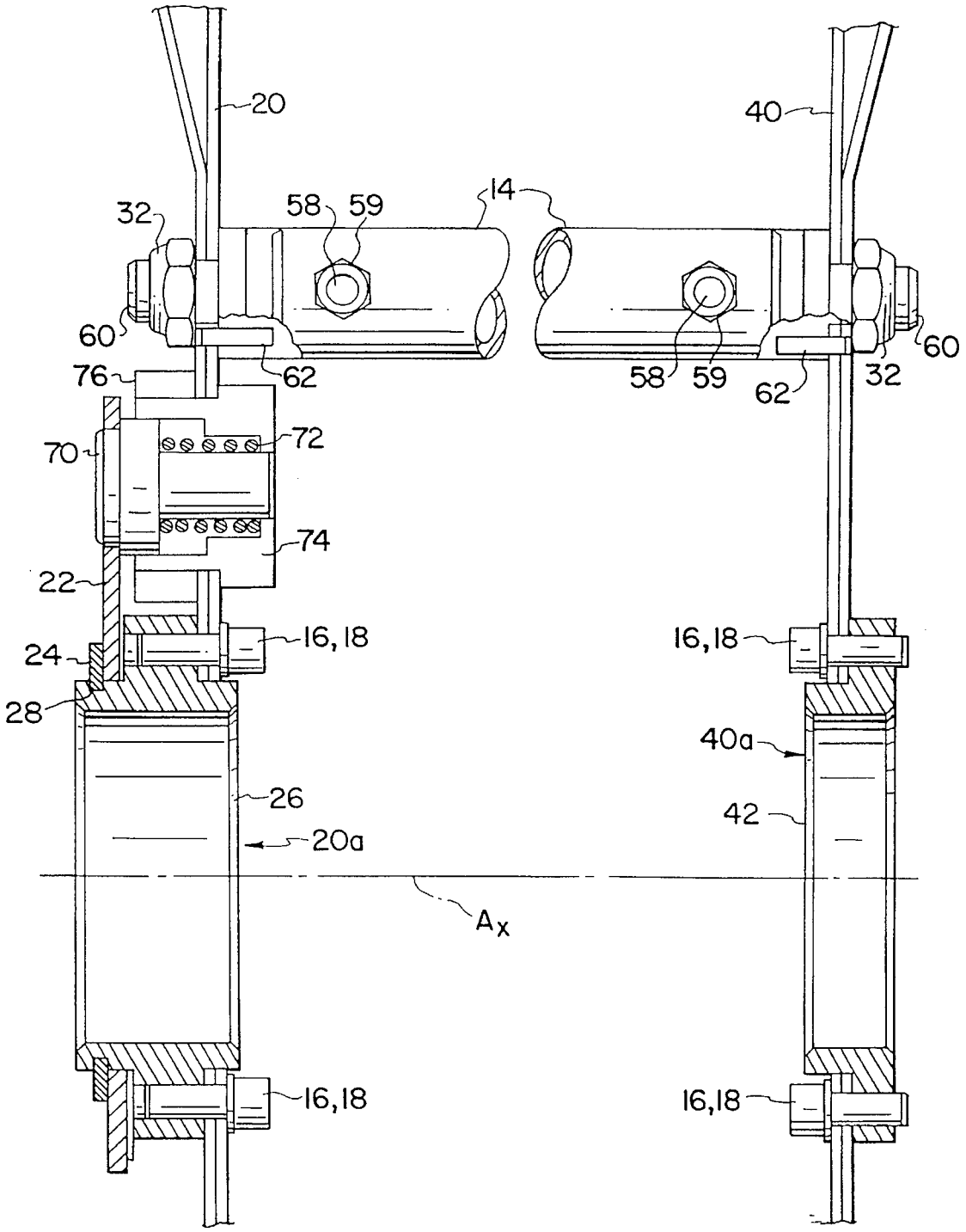
FIG. 4 is a partial cross-sectional side view of the barrel folding reel in its operative position as encompassed by the first embodiment of the present invention.

As shown in FIG. 3, an annular-shaped actuator flange bearing journal 26 extends through the central aperture 20*a* of the annular-shaped actuator flange 20. Similarly, an annular-shaped plain flange bearing journal 42 extends through the central aperture 40*a* of the annular-shaped plain flange 40. As shown in FIGS. 3 and 4, bearing journal screws 16 and lock washers 18 attach the flange bearing journals 26 and 42 to flanges 20 and 40, respectively.

An actuator plate 22 is positioned adjacent to the outer face 20*b* of the inner annular area of constant thickness of the actuator flange 20. The actuator plate 22 has a substantially central aperture (unnumbered). The diameter of the central aperture of the actuator plate 22 is sized to engage the outer periphery of the actuator flange bearing journal 26. Moreover, the actuator plate 22 is constructed and dimensioned with respect to the actuator flange bearing journal 26 to allow for partial rotational movement of the actuator plate 22 relative to the actuator flange bearing journal 26.

A peripheral groove 28 extends around the outer periphery of the actuator flange bearing journal 26 for receiving an annular-shaped actuator plate retaining clip or ring 24, which is sized so that its radially inner portion is received in the peripheral groove 28. The actuator plate 22 is positioned intermediate the outer face 20*b* of the actuator flange 20 and the actuator plate retaining ring 24. The actuator plate retaining ring 24 is further constructed and dimensioned so that its radially outer portion partially overlays the actuator plate 22, thereby maintaining engagement of the actuator plate 22 to the actuator flange bearing journal 26.

Figure 14:
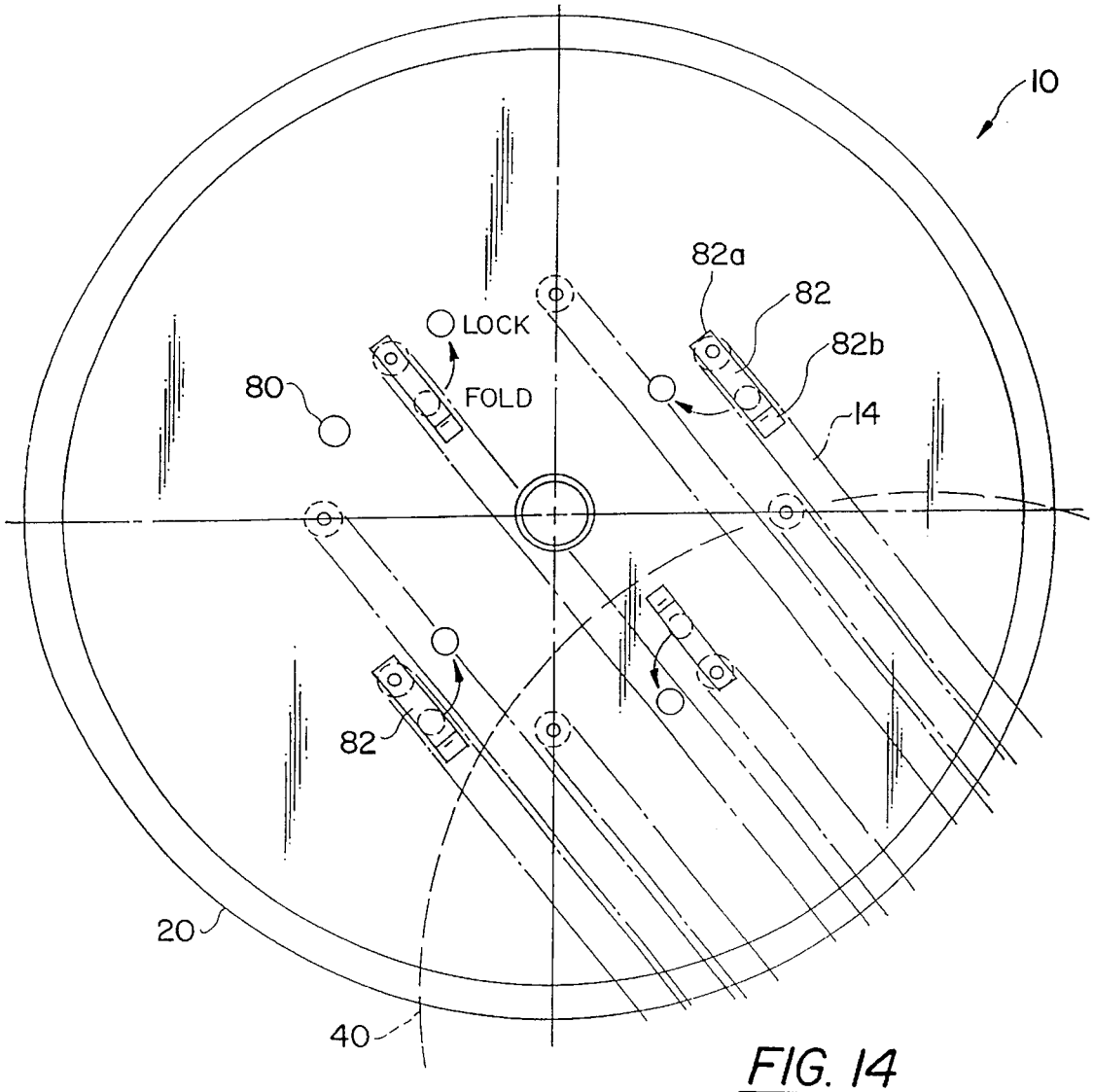
FIG. 14 is an end view of an actuating reel flange as encompassed by a third embodiment of the present invention.
Figure 15:
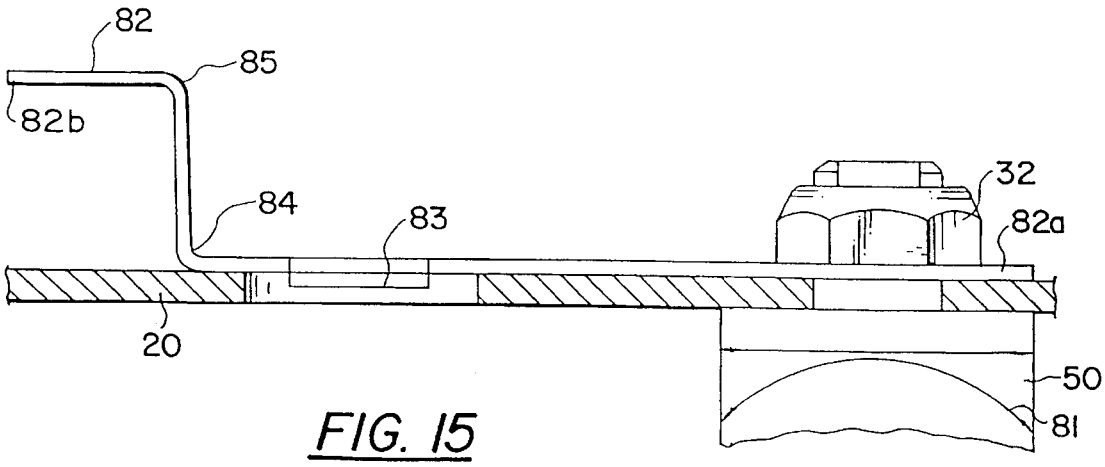
FIG. 15 is a partial cross-sectional view of an alternative locking mechanism as encompassed by the third embodiment of the present invention.

It should be understood that the shape and dimensions of the actuator plate 22 are not limited to a substantially triangular-shaped plate; instead, the actuator plate 22 may be constructed and dimensioned to form various alternative designs, as shown in FIGS. 14 and 15 for example.

In its operative position, the barrel folding reel 10 further includes a plurality of barrel members or tubes 14 positioned perpendicular to and extending longitudinally between the flanges 20 and 40. The barrel tubes 14 are equidistant from the central axis $A_x$ and are arranged to collectively define a cylindrical barrel portion 12 that is concentrically situated with respect to the flanges 20 and 40. The barrel portion 12 supports the cable or wire or the like while it is being wound, transported, and unwound.

As illustrated in FIG. 1, the actuator plate 22 engages some, but not all, of the plurality of barrel tubes 14. For example, in FIG. 1, the actuator plate 22 engages the first end portion 14*a* (which is pivotally mounted to the actuator flange 20) of three of the six barrel tubes 14; however, the actuator plate 22 does not engage the first end portion 14*a* of the other three barrel tubes 14.

Respective connecting assemblies (50, 60 or 65) pivotally mount a first end portion 14*a* and a second end portion 14*b* of each barrel tube 14 to the actuator flange 20 and the plain flange 40, respectively. The particular connecting assembly selected for mounting the end portions 14*a* and 14*b* to corresponding flanges 20 and 40 is dependent upon whether or not a particular barrel tube 14 engages the actuator plate 22. For barrel tubes 14 which have a first end portion 14*a* that engages the actuator plate 22, the first end portion 14*a* thereof is connected to the actuator flange 20 by a rotating, locking/releasing barrel tube connector 50, while the second end portion 14*b* thereof is connected to plain flange 40 by rotatable connector (herein also referred to as rotating barrel tube connector) 65. On the other hand, for barrel folding tubes which have a first end portion 14*a* that does not engage the actuator plate 22, both end portions 14*a* and 14*b* thereof are connected to corresponding flanges 20 and 40 by non-rotatable connector (herein also referred to as fixed non-rotating barrel tube connectors) 60.

Figure 6:
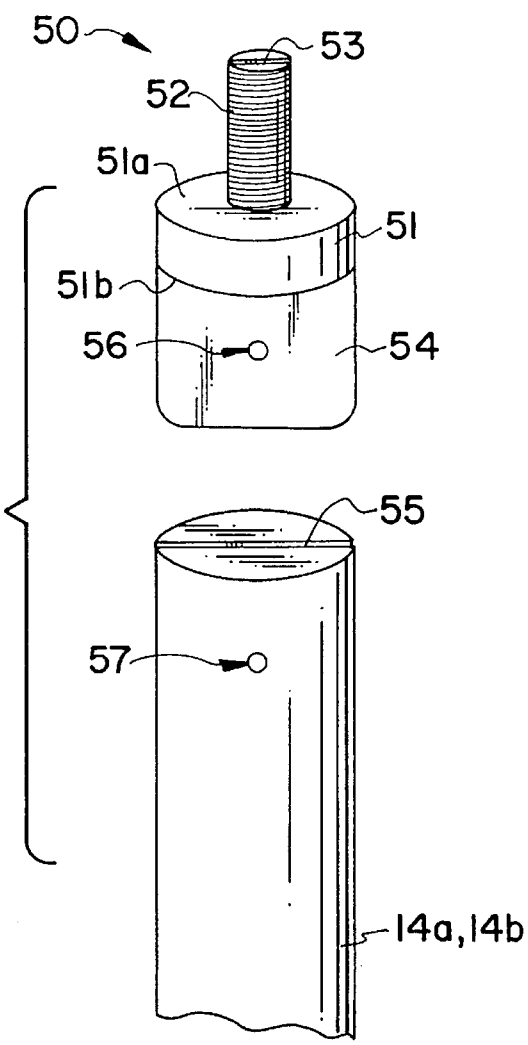
FIG. 6 is an exploded side view of a barrel tube connector showing the connection between the barrel tube connector and an end of a barrel tube.
Figure 5:
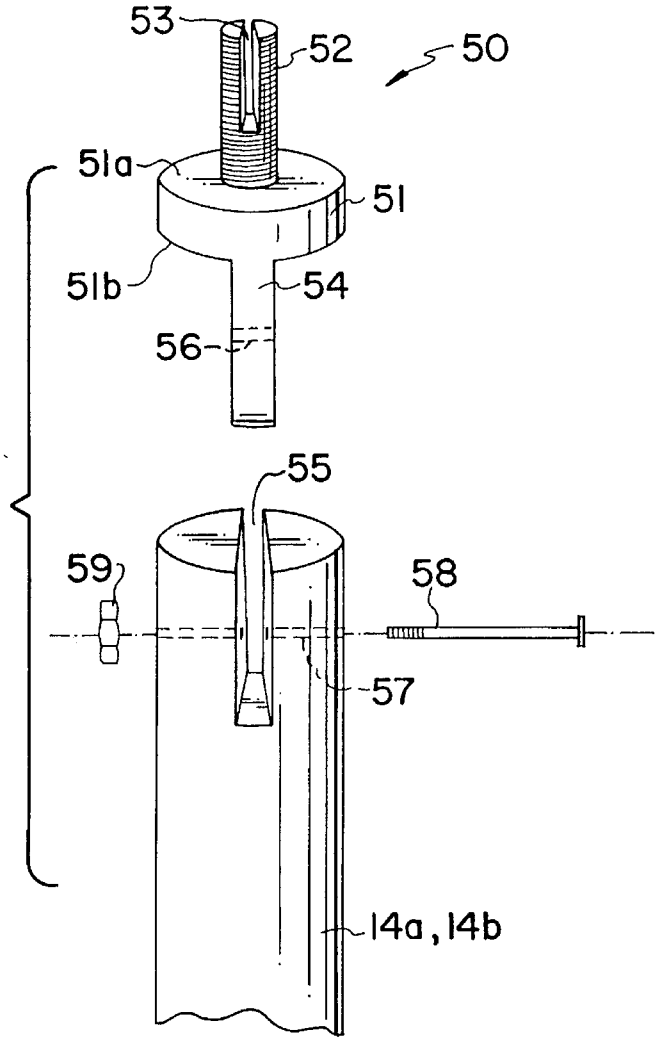
FIG. 5 is an exploded front view of a barrel tube connector showing the connection between the barrel tube connector and an end of a barrel tube.

As shown in FIGS. 5 and 6, each of the locking/releasing (rotatable) connectors 50 includes a disc-shaped base plate 51, a screw-threaded stub-shaft 52 extending from the center of a first face 51*a* of the base plate 51 and having a slot 53 therein, and a block 54 diametrically positioned and extending from a second face 51*b* of the base plate 51. The distal corners of the block 54 are beveled (FIG. 6). A hole 56 extends through the block 54 at approximately the center thereof.

The rotating connectors 65 and the non-rotating connectors 60 possess substantially the same construction as the locking/releasing connectors 50, with the exception that the slot 53 is absent from the screw-threaded stub-shaft 52 of connectors 65 and 60.

Engagement between the connector assemblies (50, 60, 65) and the respective barrel tubes 14 is now explained. As illustrated in FIGS. 3, 5, and 6, respective slots 55 diametrically bisect the end portions 14*a* and 14*b* of each barrel tube 14. Respective holes also extend through both end portions 14*a* and 14*b* of each barrel tube 14 to define cylindrical bores 57 that are transverse to the respective slots 55. For each connector assembly (50, 60, 65), the integral block 54 is dimensioned to engage the slot 55 of the corresponding barrel tube 14. The block 54 is disposed in the slot 55 so that hole 56 and bore 57 are aligned. A pin 58 is inserted through hole 56 and bore 57. A lock nut 59 secures the pin 58 in place. This construction and arrangement allows for pivotal movement of the barrel tube 14 about the corresponding pin 58 which acts as a pivot axis.

Figure 7:
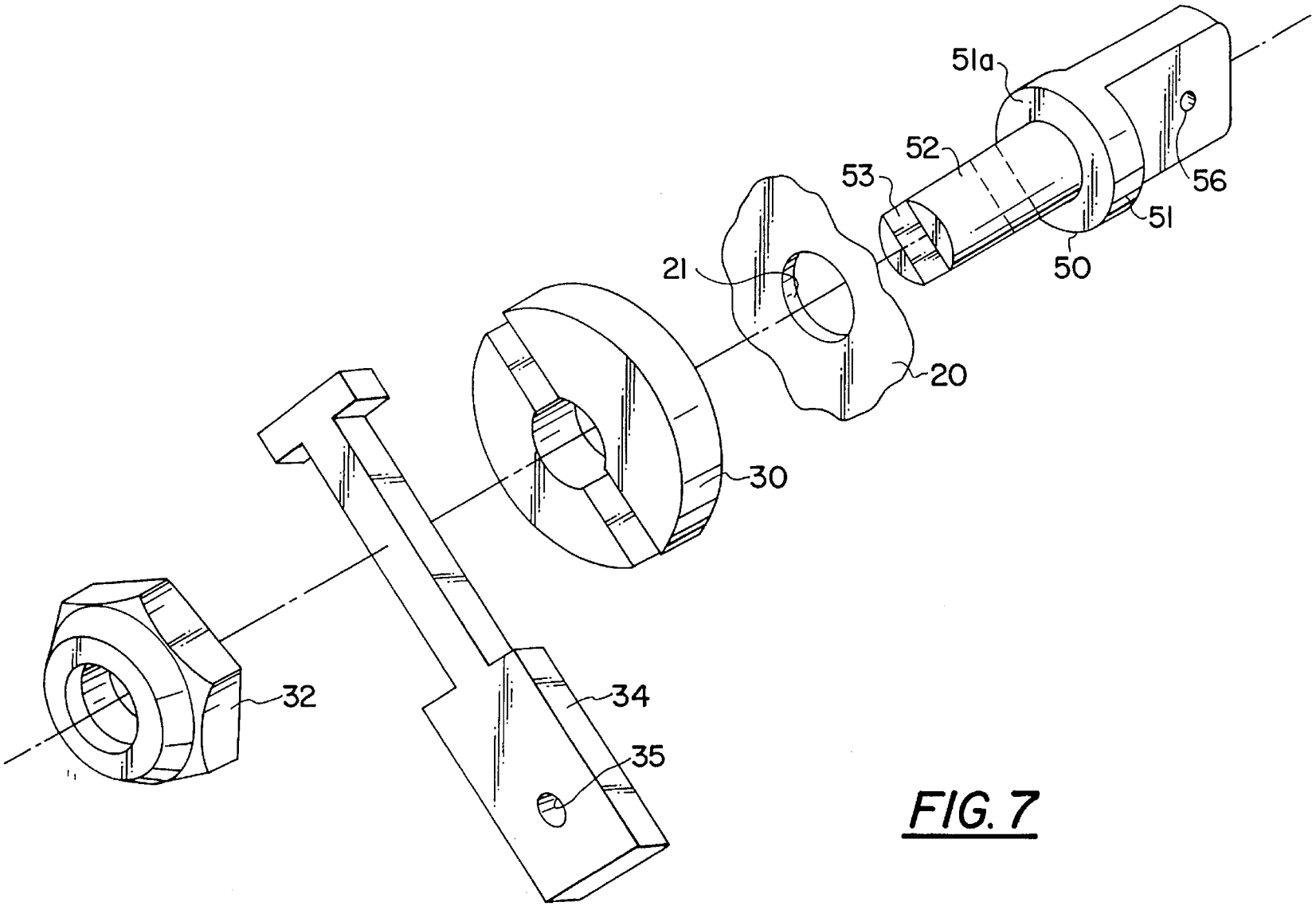
FIG. 7 is a perspective exploded view of a locking/releasing barrel tube connector showing the connection between the locking/releasing barrel tube connector and the actuator flange.

Engagement of the locking/releasing connector 50 to the actuator flange 20 and the actuator plate 22 is now explained. As shown in FIG. 7, for each locking/releasing connector 50, the base plate 51 is disposed such that its first face 51*a* is positioned adjacent to the inner face 20*c* of the actuator flange 20. The slotted screw-threaded stub-shaft 52 extends through an aperture 21 located within the inner annular area of constant thickness of the actuator flange 20. A slotted washer 30 and a lock nut 32, disposed on the outer face 20*b* of the actuator flange 20, interact with the screw-threaded stub-shaft 52 of the locking/releasing connector 50, thereby securing the connection between the actuator flange 20 and the locking/releasing connector 50.

Figure 8:
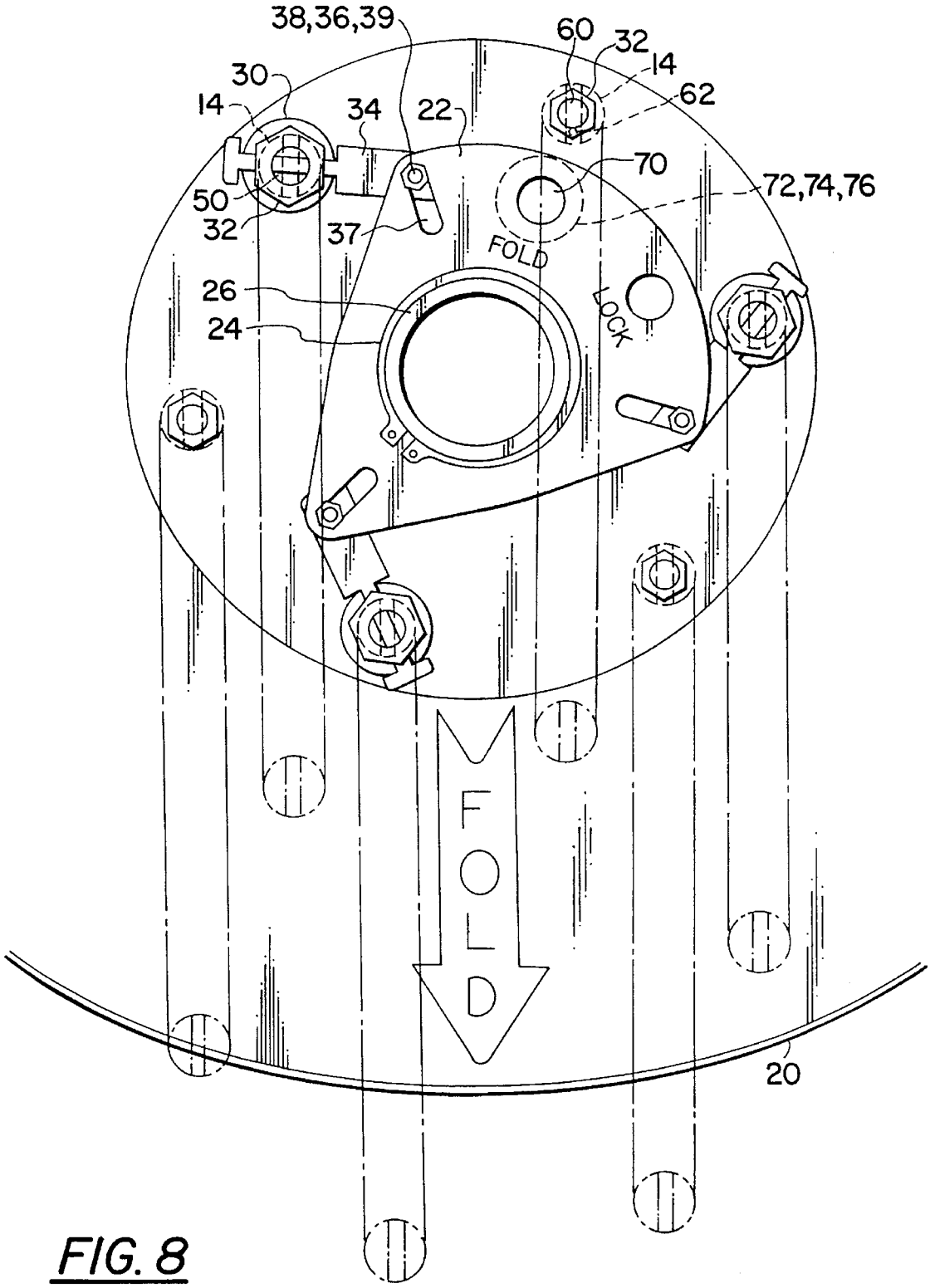
FIG. 8 is a partial end view of the face of the actuator reel flange showing the actuator plate in the collapsible position as encompassed by the first embodiment of the present invention.
Figure 9:
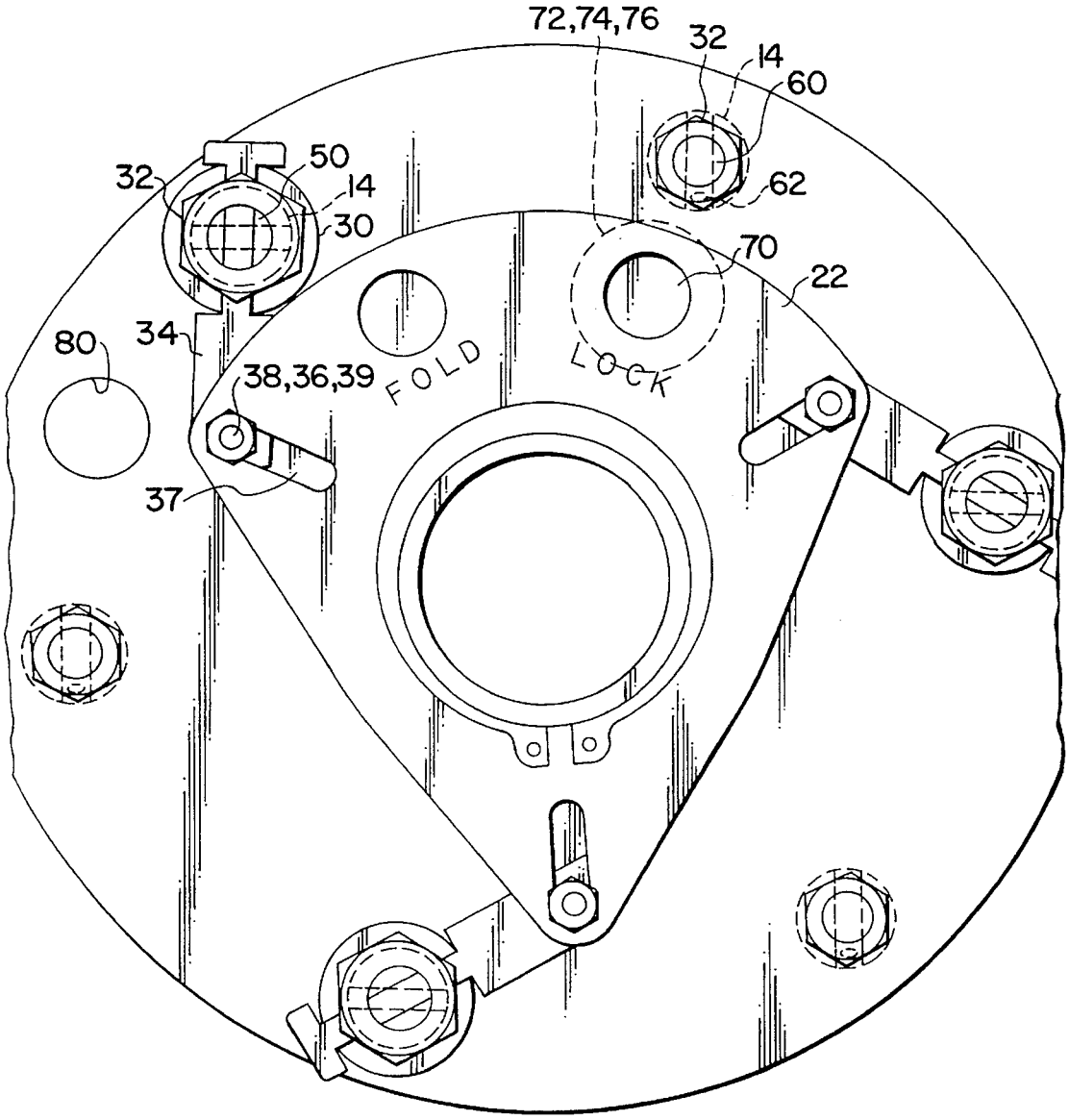
FIG. 9 is an end view of the face of the actuator reel flange showing the actuator plate locked in the operative position as encompassed by the first embodiment of the present invention.

As shown in FIGS. 3, 8, and 9, each of the locking/releasing connectors 50 (and corresponding barrel tubes 14) engages the actuator plate 22 by a respective actuator link 34. A neck portion (unnumbered) of each respective actuator link 34 is dimensioned to fit within the recess of the slotted washer 30 and the slot 53 of the screw-threaded stub-shaft 52. Each locking/releasing connector 50 is secured to its respective actuator link 34 by arranging the neck of the respective actuator link 34 within the slot 53 of the screw-threaded stub-shaft 52 such that the neck is positioned intermediate the slotted washer 30 and lock nut 32.

The opposite end (unnumbered) of each actuator link 34 has a hole 35 located therein. For each actuator link 34, the hole 35 is aligned with one of a plurality of elongated slots 37 located near the edge of the actuator plate 22. A link connecting screw 36 is fit through the hole 35 and the elongated slot 37, thereby engaging the actuator link 34 to the actuator plate 22. A link bushing 38 and a lock nut 39 secure the connection between the actuator link 34 and the actuator plate 22.

For each barrel tube 14 that engages the actuator plate 22, the second end portion 14*b* thereof is pivotally mounted to the plain flange 40 by a rotating connector 65. As shown in FIG. 3, a screw-threaded stub-shaft 52 (not having a slotted portion) of the rotating connector 65 extends through an aperture 21 located within the inner annular area of constant thickness of the plain flange 40. A lock nut 32 positioned on the outer face of the plain flange 40 interacts with the screw-threaded stub-shaft 52 of the rotating connector 65, thereby securing the rotating connector 65 (and its corresponding barrel tube 14) to the plain flange 40.

Engagement of the non-rotating connectors 60 (and corresponding barrel tubes 14 which do not engage the actuator plate 22) with flanges 20 and 40 is illustrated in FIG. 4. For each of the non-rotating connectors 60, the base plate 51 is disposed such that its first face 51*a* is positioned adjacent to the inner face of the corresponding flange 20 or 40. The screw-threaded stub-shaft 52 (not having a slotted portion) extends through an aperture 21 located within the inner annular area of constant thickness of the corresponding flange 20 or 40. Lock nuts 32 disposed on the outer face of the corresponding flange 20 or 40 interact with screw-threaded stub-shafts 52 of the non-rotating connectors 60, thereby securing the connection between the non-rotating connector 60 (and its corresponding barrel tube 14) and corresponding flange 20 or 40. Each non-rotating connector further includes a fixed connector pin 62 that engages the corresponding flange and prevents the non-rotating connectors 60 and corresponding barrel tube 14 from rotating about their longitudinal axes.

It should be understood that alternative devices and constructions may be used for preventing the rotation of the non-rotating connectors 60 and corresponding barrel tubes 14 about their longitudinal axes. For example, each of the non-rotating connectors 60 may include a square-shaped cross-sectional portion (not shown) located intermediate the base plate 51 and the screw-threaded stub-shaft 52. These square-shaped portions may be countersunk in corresponding square-shaped recesses (not shown) in the flanges 20 and 40 to prevent rotation of the non-rotating connectors 60.

Movement of the barrel folding reel 10 between its operative position and collapsed position is now explained in greater detail. In particular, FIGS. 1 and 9 together illustrate the arrangement of the actuator plate 22, the barrel tubes 14, and the connector assemblies (50, 65, 60) when the barrel folding reel 10 is in its operative position. When in its operative position, the longitudinal axes of the respective pins 58 of the locking/releasing connectors 50 and rotating connectors 65 are arranged parallel to each other; however, the longitudinal axes of the pins 58 of connectors 50 and 65 are perpendicular to (and not pivotally aligned with) the longitudinal axes of the pins 58 of the non-rotating connectors 60. In other words, the connectors 50 and 65 and their corresponding barrel tubes 14 are rotated ninety degrees about their longitudinal axis in reference to the non-rotating connectors 60. The nonalignment of connectors 50 and 65 with non-rotating connectors 60 impedes the pivotal movement of the barrel tubes 14 about their attaching pins 58. The barrel folding reel 10 is thereby maintained in its operative position.

Movement of the barrel folding reel 10 into its collapsible position is accomplished by first partially rotating the actuator plate 22 in a clockwise direction from a first position (FIG. 9) to a second position shown in FIG. 8. Rotation of the actuator plate 22 in turn displaces the actuator links 34, causing the locking/releasing connectors 50 (and the corresponding barrel tubes 14 and rotating connectors 65 engaged thereto) to collectively rotate ninety degrees along their longitudinal axes from a first rotational position (FIG. 9) to a second rotational position (FIG. 8). The connectors 50 and 65 are thereby pivotally aligned with the non-rotating connectors 60, such that the longitudinal axes of the pins 58 of the connector assemblies (50, 60, 65) are in parallel arrangement in relation to each other.

Figure 10:
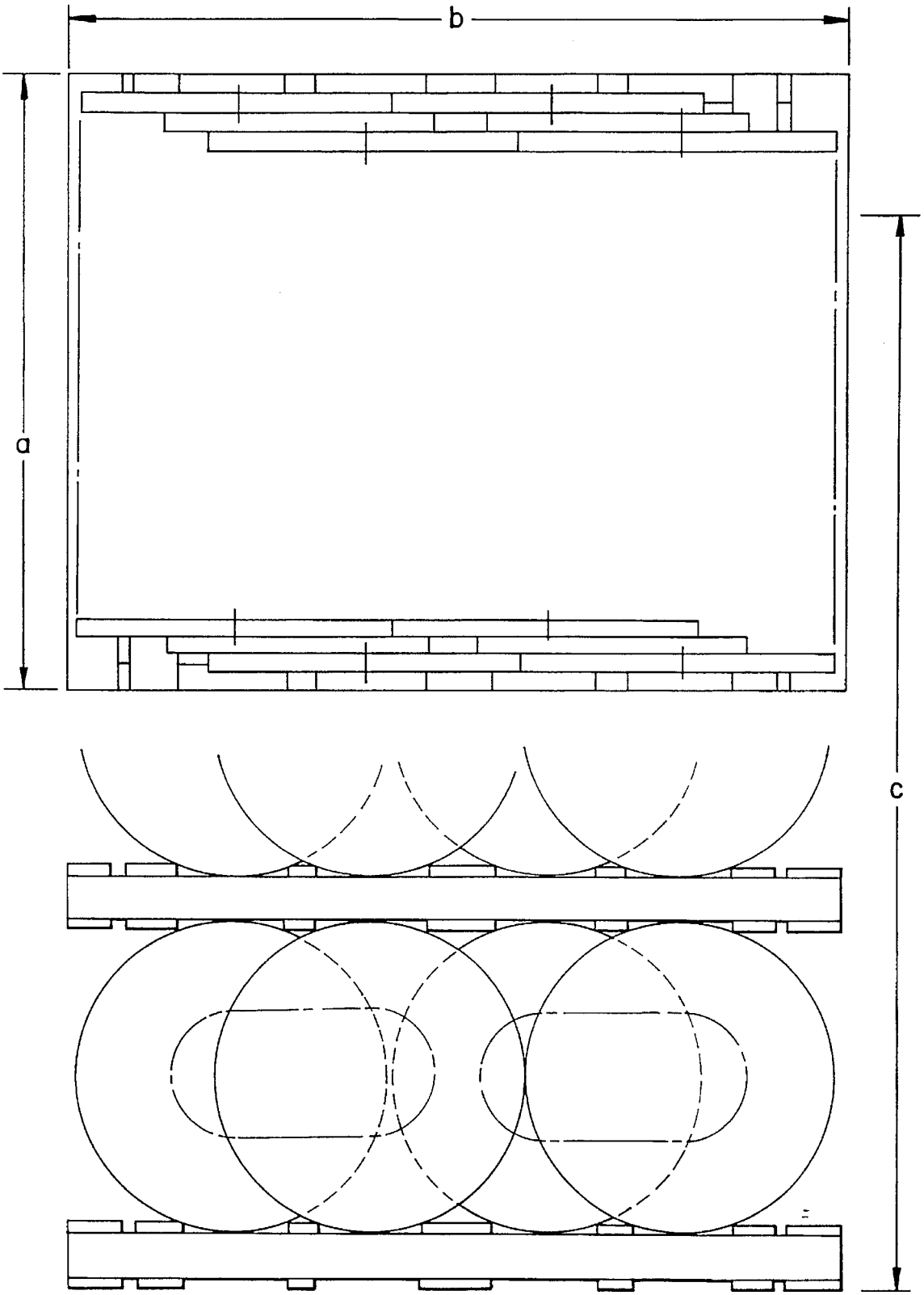
FIG. 10 is a diagram showing how a typical 24 inch diameter flange reel is packed on a pallet for compact shipping.

After the connector assemblies (50, 60, 65) have been pivotally aligned, the empty barrel folding reel 10 can be folded into its collapsed position by exerting a lateral force to the actuator flange 20 (or alternatively, exerting a lateral force to the plain flange 40). Such a force causes the end portions 14*a* and 14*b* of the barrel tubes 14 to undergo pivotal movement about their respective pins 58. The coaxially alignment of the flanges 20 and 40 is interrupted as the actuator flange 20 is translated towards the plain flange 40 while remaining in a parallel relation thereto. In the collapsed position, the barrel tubes 14 are flatly positioned against the inner faces of the flanges 20 and 40 such that the flanges are substantially adjacent to one another. As shown in FIG. 10, the end faces of the flanges 20 and 40 partially overlap each other.

It should be noted that the ends 14*a* and 14*b* of the barrel tubes 14 may be defined by curved surfaces 81 (FIG. 11) in order to prevent small or thin wires from wedging between the connector assemblies (50, 60, 65) and the barrel tubes 14.

Figure 11:
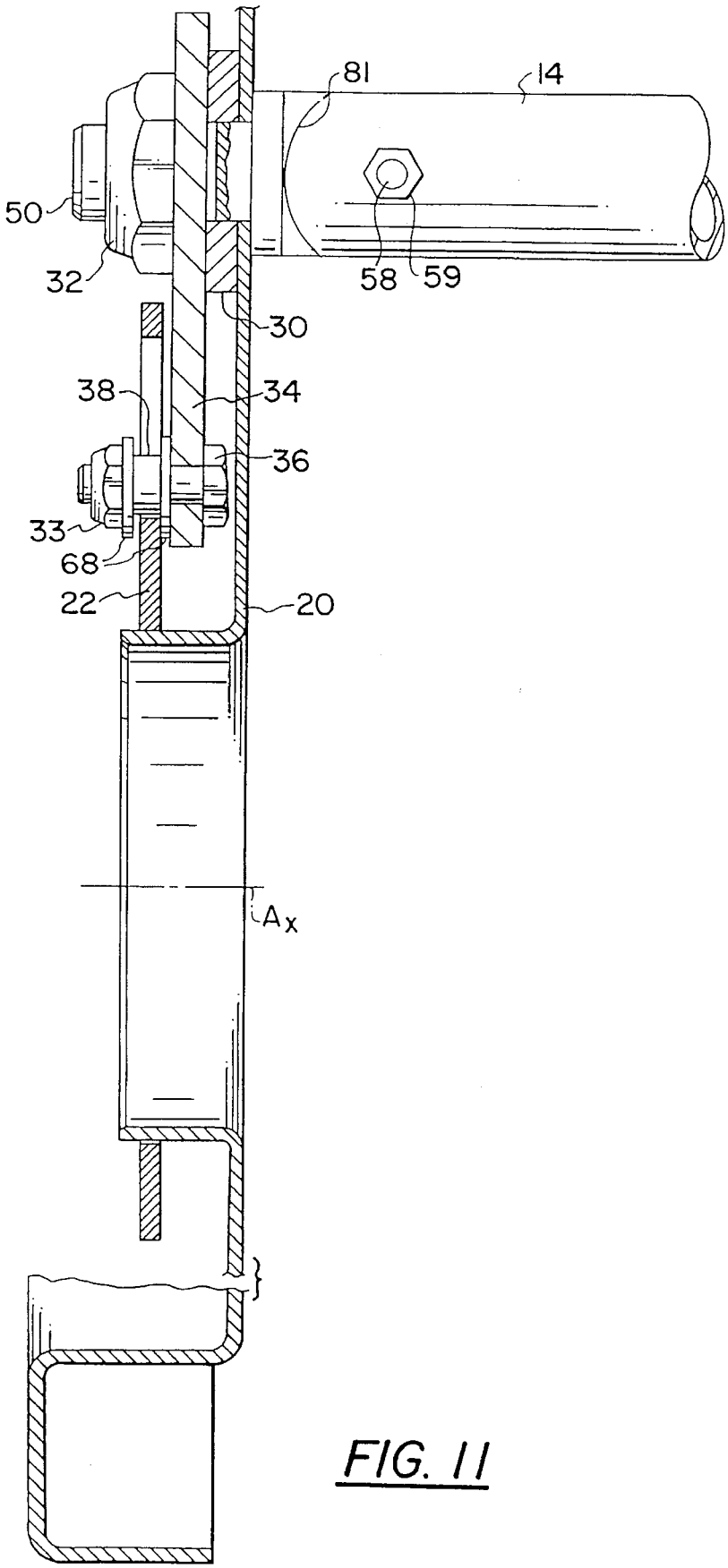
FIG. 11 is a partial cross-sectional view showing the actuator reel flange as encompassed by a second embodiment of the present invention.

A second embodiment of a barrel folding reel 10 according to the present invention is herein described with reference to FIG. 11. The barrel folding reel 10 according to the second embodiment of the present invention includes substantially the same construction and design provided above in the first embodiment. However, the second embodiment eliminates the actuator plate retaining ring 24, actuator flange bearing journal 26, plain flange bearing journal 42, and the bearing journal screws 16. A plurality of actuator links 34 provides sufficient support to secure the actuator plate 22 in place and to allow for the rotational movement of the actuator plate 22. Flat washers 68 are disposed adjacent to and on opposing sides of the actuator plate 22.

Finally, a locking mechanism may be included to securely lock the barrel folding reel 10 in its operative position. As shown in FIG. 4, the locking mechanism includes an actuator plate lock pin 70 that contains a lock pin spring 72 and a lock pin bushing 74 surrounding the lock pin spring 72. When in its locking position, the lock pin 70 engages the actuator plate 22 and the actuator flange 20, thereby impeding the rotation of the actuator plate 22 with respect to the actuator flange 20. The lock pin spring 72 is loaded so the lock pin 70 can be depressed to release the lock pin 70 and allow the actuator plate 22 to be rotated. The barrel folding reel 10 can then be moved from its operative position to its collapsible position.

Figure 12:
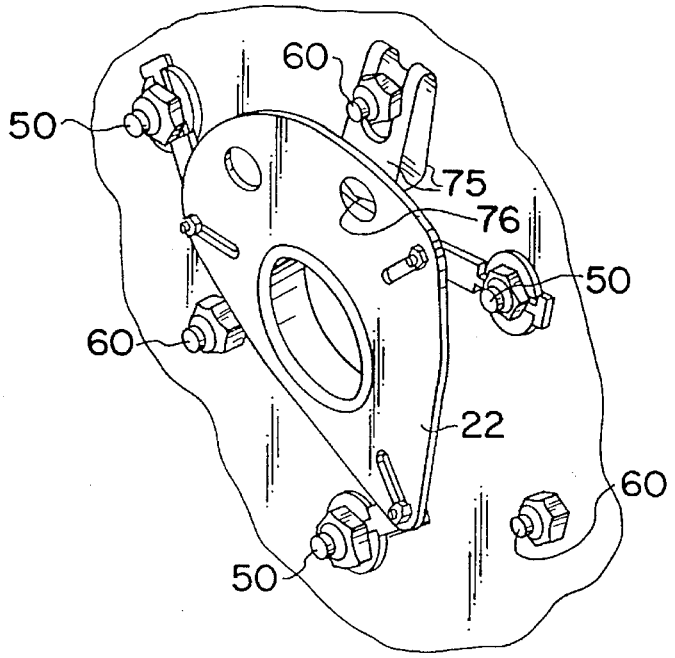
FIG. 12 is a perspective view of the present invention having an alternative locking mechanism.
Figure 13:
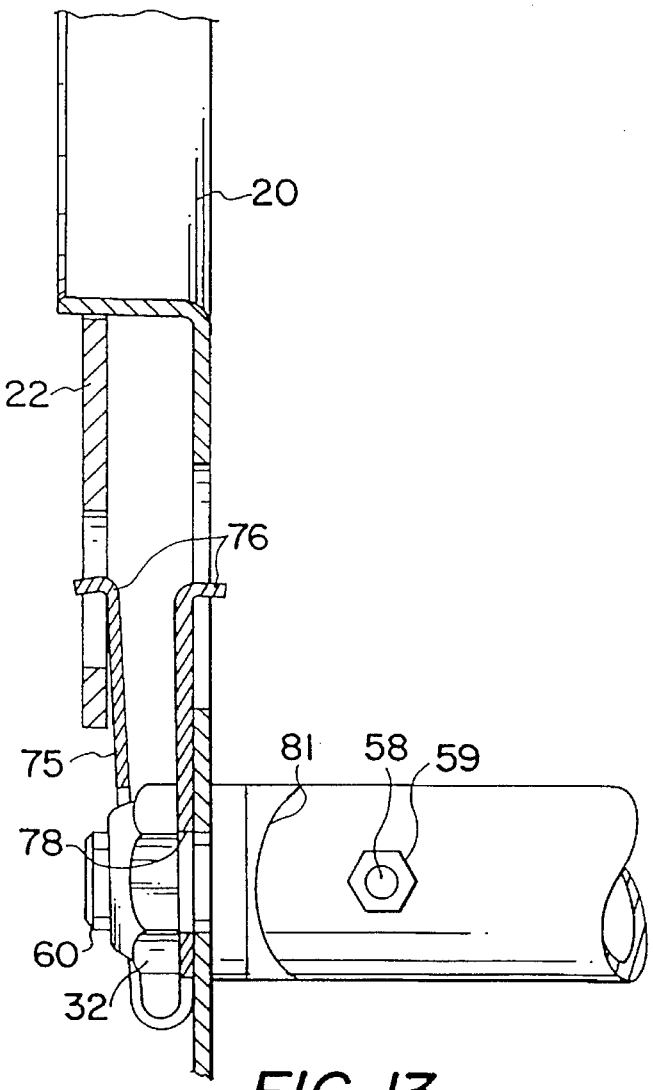
FIG. 13 is a partial side cross-sectional view of the face of the actuator reel flange having an alternative locking mechanism.

As shown in FIGS. 12 and 13, an alternative locking mechanism encompassed by the present invention includes a lock spring 75. The lock spring 75 possesses outward arched terminal ends 76. When viewed from the side, the lock spring 75 has a substantially U-shaped configuration. In its locking position, one of the terminal ends 76 is fit through an aperture (unnumbered) located in the actuator flange 20; the other terminal end 76 is fit through an aperture (unnumbered) located in the actuator plate 22. The lock spring 75 further includes a retaining hole 78 that is sized to engage a lock nut 32 of either a locking/releasing connector 50 or a non-rotating connector 60. Movement of the actuator plate 22, and thus rotation of the barrel tubes 14 attached thereto, is thereby impeded.

A third embodiment of the present invention possessing another alternative locking mechanism is shown in FIGS. 14 and 15. According to this third embodiment, the actuator plate 22 is replaced by at least one elongated actuator lever 82 having a respective first end 82*a* and a respective second end 82*b*. Each actuator lever 82 is preferably a thin strip of material having a first bent portion 84 and a second bent portion 85 that collectively space the second end 82*b* of the actuator lever 82 apart from the outer face 20*b* of the actuator flange 20. The actuator lever 82 also preferably has a protruding portion 83 located on the lower surface thereof adjacent to said first bent portion 84.

Each actuator lever 82 is preferably pivotally connected at it first end 82*a* to a corresponding locking/releasing connector 50 so that the second end 82*b* can be pivotally moved between a first position and a second position. The protruding portion 83 engages respective holes (unnumbered) in the actuator flange 20 for locking the actuator lever 82 in its first or second position. When the actuator lever 82 is locked in its first position, the locking/releasing connectors 50 are not pivotally aligned with the non-rotating connectors 60, so that the barrel folding reel 10 is locked in its operative position. Movement of the actuator lever 82 into its second position causes the corresponding locking/releasing connector 50 to rotate ninety degrees about its longitudinal axis and into alignment with the non-rotating connectors 60. By pivotally moving and locking all of the plurality of actuator levers 82 to their respective second positions, the barrel folding reel 10 can be moved from its operative position and into its collapsed position.

The third embodiment of the present invention is particularly useful for barrel folding reels 10 of large sizes, where it is impractical to employ a single, integral actuator plate 22.

Although the present invention has been described in detail with reference to its presently preferred embodiment, it will be understood by those of ordinary skill in the art that various modifications and improvements to the present invention are believed to be apparent to one skilled in the art. Accordingly, no limitation upon the invention is intended, except as set forth in the appended claims.

What is claimed is:

1. A collapsible reel comprising:

first and second flanges having respective facing inner surfaces;

a plurality of spaced members extending between, and being pivotally connected to, said inner surfaces to maintain said inner surfaces in mutually parallel planes, said members having respective longitudinal axes arranged parallel to one another, said members being connected to said first flange about respective pivot axes which extend parallel to said inner surface of said first flange, said plurality of members comprising at least one first member and at least one second member; and an actuator member engaged with said at least one first member and movable between first and second positions for rotating said at least one first member about said longitudinal axis thereof between, respectively: (1) a first rotational position in which said pivot axis of said at least one first member is in nonparallel relationship with the corresponding pivot axis of said at least one second member, and (2) a second rotational position in which said pivot axis of said at least one first member is in parallel relationship with the corresponding pivot axes of the remaining members, thereby permitting collective pivotal movement of said members with respect to said flanges between a collapsed position when said second rotational position is obtained, at which said flanges are positioned substantially adjacent to one another, and an operative position at which said flanges are spaced such that the planes of said inner surfaces are perpendicular to said longitudinal axes of said members, said flanges being retained in said operative position when said actuator member is moved to said first position.

2. A collapsible reel as recited in claim 1, wherein said actuator member engages a first end portion of said at least one first member, said first end portion being connected to said first flange.

3. A collapsible reel as recited in claim 2, wherein said at least one first member is rotatable ninety degrees about said longitudinal axis thereof between said first and second rotational positions.

4. A collapsible reel as recited in claim 3, wherein said actuator member is rotatable between said first and second positions.

5. A collapsible reel as recited in claim 1, wherein said actuator member does not engage said at least one second member.

6. A collapsible reel comprising:

first and second flanges having respective facing inner surfaces;

a plurality of rotatable and non-rotatable members extending between, and being pivotally connected to, said inner surfaces to maintain said inner surfaces in mutually parallel planes, said rotatable and non-rotatable members having respective longitudinal axes arranged parallel to one another, said rotatable and non-rotatable members being connected to said first flange about respective pivot axes which extend parallel to said inner surface of said first flange; and an actuator member engaged with said rotatable members and movable between first and second positions for rotating said rotatable members about said respective longitudinal axes thereof between, respectively: (1) first rotational positions in which said respective pivot axes of said rotatable members are in nonparallel relationship with the corresponding pivot axes of said non-rotatable members, and (2) second rotational positions in which said respective pivot axes of said rotatable members are in parallel relationship with the corresponding pivot axes of said non-rotatable members, thereby permitting collective pivotal movement of said rotatable and non-rotatable members with respect to said flanges between a collapsed position when said second rotational positions are obtained, at which said flanges are positioned substantially adjacent to one another, and an operative position, at which said flanges are spaced such that the planes of said inner surfaces are perpendicular to said longitudinal axes of said members, said flanges being retained in said operative position when said actuator member is moved to said first position.

7. A collapsible reel as recited in claim 6, further comprising:

first rotatable connectors that respectively pivotally connect first end portions of said rotatable members to said first flange;

second rotatable connectors that respectively pivotally connect second end portions of said rotatable members to said second flange;

first non-rotatable connectors that respectively pivotally connect first end portions of said non-rotatable members to said first flange; and second non-rotatable connectors that respectively pivotally connect second end portions of said non-rotatable members to said second flange.

8. A collapsible reel as recited in claim 7, wherein each said first or second non-rotatable connector includes a square-shaped cross-sectional portion disposed in a recess of the corresponding flange.

9. A collapsible reel as recited in claim 7, further comprising actuator links that respectively connect said actuator member to said first rotatable connectors.

10. A collapsible reel as recited in claim 7, wherein said actuator member is rotatable between said first and said second positions.

11. A collapsible reel as recited in claim 10, wherein said rotatable members are rotatable ninety degrees about said respective longitudinal axes between said first and second rotational positions.

12. A collapsible reel as recited in claim 11, wherein said actuator member does not engage said non-rotatable members.

13. A collapsible reel as recited in claim 5 or 11, wherein each member of said plurality of members has beveled ends.

14. A collapsible reel as recited in claim 5 or 11, wherein said first flange further includes a bearing journal and a retaining ring, said bearing journal and said retaining ring being disposed so as to secure said actuator member to said first flange.

15. A collapsible reel as recited in claim 5 or 11, wherein said actuator member includes a locking means for maintaining said collapsible reel in said operative position.

16. A collapsible reel as recited in claim 5 or 11, wherein said actuator member has a generally triangular plate-like shape.

17. A collapsible reel comprising:

first and second flanges having respective facing inner surfaces;

a plurality of rotatable and non-rotatable members extending between, and being pivotally connected to, said inner surfaces to maintain said inner surfaces in mutually parallel planes, said rotatable and non-rotatable members having respective longitudinal axes arranged parallel to one another, said rotatable and non-rotatable members being connected to said first flange about respective pivot axes which extend parallel to said inner surface of said first flange; and a plurality of actuator members, each of said actuator members being engaged with and corresponding to one of said rotatable members, and each of said actuator members being movable between first and second positions for rotating said corresponding rotatable member about said longitudinal axes thereof between, respectively: (1) a first rotational position in which said pivot axis of said rotatable member is in nonparallel relationship with the corresponding pivot axes of said non-rotatable members, and (2) a second rotational position in which said pivot axis of said rotatable member is in parallel relationship with the corresponding pivot axes of said non-rotatable members, thereby permitting collective pivotal movement of said rotatable and non-rotatable members with respect to said flanges between a collapsed position when said actuator members are in said second positions, at which said flanges are positioned substantially adjacent to one another, and an operative position, at which said flanges are spaced such that the planes of said inner surfaces are perpendicular to said longitudinal axes of said members, said flanges being retained in said operative position when any one of said actuator members is moved to said first position.

18. A collapsible reel as recited in claim 17, wherein each of said actuator members is an elongated strip having a surface facing said first flange, said surface having a protruding portion that is received in a corresponding recessed portion of said first flange when said actuator member is in said first position.

19. A collapsible reel as recited in claim 17, wherein each of said actuator members is rotatable between said first and second positions.

20. A collapsible reel as recited in claim 17 or 19, wherein each of said actuator members is an elongated strip.

21. A collapsible reel as recited in claim 17, wherein each of said rotatable members is rotatable ninety degrees about said longitudinal axis thereof between said first and second rotational positions.

22. A collapsible reel as recited in claim 21, further comprising a locking means for locking said rotatable members in said first rotational position.

23. A collapsible reel as recited in claim 17, further comprising:

first rotatable connectors that respectively pivotally connect first end portions of said rotatable members to said first flange;

second rotatable connectors that respectively pivotally connect second end portions of said rotatable members to said second flange;

first non-rotatable connectors that respectively pivotally connect first end portions of said non-rotatable members to said first flange; and second non-rotatable connectors that respectively pivotally connect second end portions of said non-rotatable members to said second flange.

24. A collapsible reel as recited in claim 23, wherein each said first or second non-rotatable connector includes a square-shaped cross-sectional portion disposed in a recess of the corresponding flange.

* * * * *